United States Patent [19]

Loewke et al.

[11] Patent Number: 4,871,139

[45] Date of Patent: Oct. 3, 1989

[54] PORTABLE, KNOCK-DOWN, RECONFIGURABLE BOOK STAND

[76] Inventors: Eunice R. Loewke, 1307 Jasmine Cir., Rohnert Park, Calif. 94928; Daniel D. Loewke, 3060 N.E. Wheeler St., Poulsbo, Wash. 98370

[21] Appl. No.: 185,956

[22] Filed: Apr. 25, 1988

[51] Int. Cl.[4] ..... A47B 97/08

[52] U.S. Cl. ..... 248/460; 248/444.1; 248/451

[58] Field of Search ..... 248/460, 455, 444.1, 248/451, 452, 165, 558, 470, 465, 461; 281/33

[56] References Cited

U.S. PATENT DOCUMENTS

| | | | |
|---|---|---|---|
| 2,691,240 | 10/1954 | Kraus | 248/460 X |
| 2,784,929 | 3/1957 | Diening | 248/463 |
| 3,041,774 | 7/1962 | Walker | 248/451 |
| 3,747,889 | 7/1973 | Gerald | 248/451 |
| 3,897,037 | 7/1975 | Johnson et al. | 248/460 |
| 3,937,435 | 2/1976 | Roberts | 248/465 X |
| 3,981,522 | 9/1976 | Bloom | 248/451 X |
| 3,999,734 | 12/1976 | Gibson et al. | 248/460 |
| 4,343,450 | 8/1982 | Anderson | 248/460 X |
| 4,496,127 | 1/1985 | Nelson | 248/441.1 |
| 4,555,128 | 11/1985 | White et al. | 248/451 X |

FOREIGN PATENT DOCUMENTS

| | | | |
|---|---|---|---|
| 45280 | 9/1908 | Switzerland | 248/460 |
| 6334 | 3/1897 | United Kingdom | 248/461 |

*Primary Examiner*—Robert W. Gibson, Jr.
*Assistant Examiner*—Karen J. Chotkowski
*Attorney, Agent, or Firm*—Howard Cohen

[57] ABSTRACT

A portable book stand for supporting an open book or other reading material includes a base member comprising a base panel and a front panel extending upwardly from one edge thereof at an acute angular relationship thereto. A support member includes a support panel and a bottom panel extending from one edge thereof an an oblique angular relationship thereto. A slot extends through the support panel of the support member directly adjacent to the bottom panel, the slot being dimensioned to receive the base panel of the base member therethrough in slidable fashion. Thusly assembled, the bottom panel and the base panel rest atop a supporting surface, and the front panel and support panel of the support panel are disposed generally parallel and spaced apart so that the lower edge of an open book may be retained on said base panel between the front panel and the support panel, the spine of the book inclined against and supported by the support panel. The spacing of the front panel and the support panel may be adjusted by the selective amount of insertion of the base panel through the slot. At least the front panel is formed of transparent material so that the book portion disposed behind the front panel is visible to the reader. The base member and support member may be formed entirely of transparent plastic or resin material. With the base member and support member separated, the base panel and support panel may be disposed to impinge on the front and back covers of a book, and secured thereabout by an elastic, band, so that the two members form a protective enclosure for the book while being carried therewith. Alternatively, one of the members may be inserted between the pages of a book as a page marker, and the other member secured to an outer cover of the book.

7 Claims, 3 Drawing Sheets

PORTABLE, KNOCK-DOWN, RECONFIGURABLE BOOK STAND

BACKGROUND OF THE INVENTION

The present invention generally relates to devices for supporting reading material so that it may be displayed advantageously for perusal and study. There are a great many readers who find reading most comfortable when sitting at a table or the like, with a book supported thereon and their hands free. Aside from casual readers, a device for supporting a book upon a surface and inclined in an upright position for reading is a great convenience, especially for cookbooks, copy material for typists, and the like.

There are known in the prior art many devices for supporting a book or similar reading material in an inclined, upright position. Generally these devices are arranged to clasp an open book between opposed members to support the book and maintain the book open to a selected pair of pages. Such apparatus often renders difficult the process of turning pages, and interrupts the flow of the substance of the reading material with the difficult manipulations required to display a new pair of pages. Furthermore, most prior art devices for supporting a book for reading are not designed for easy portability, and thus cannot be transported with a book. Since many book lovers carry a book with them and read it during free moments, it would be highly desirable to have a book stand that is portable, simply disassembled and erected, lightweight, and inexpensive.

Some book stands that are portable comprise a support bracket inclined upwardly to support the spine of a book, and a tension member extending laterally behind the covers of the open book and secured to the opposed edges of the front and back book covers maintain the book in an opened disposition. Such devices are not well adapted to hold the pages fully open, and require hard cover books to be effective. If such a device is provided with clamps at the opposed ends of the tension member to maintain the book open to the desired pages, the clamps interfere with the process of turning the pages.

SUMMARY OF THE PRESENT INVENTION

The present invention generally comprises a stand for supporting a book or similar reading material, and is particularly designed to be portable with a book. Moreover, the stand is designed to be disassembled and reerected with considerable ease, with the components of the stand adapted to be reconfigurable as a protective enclosure for the book it accompanies.

The book stand of the present invention includes a base member comprising a first planar portion and a front panel extending upwardly from one edge thereof at an acute angular relationship thereto. A support member includes a second planar portion and a bottom panel extending from one edge thereof an an oblique angular relationship thereto. A slot extends through the second planar portion of the support member directly adjacent to the bottom panel, the slot being dimensioned to receive the first planar portion of the base member therethrough in slidable fashion. Thusly assembled, the bottom panel and the first planar portion rest atop a supporting lateral surface, and the front panel and second planar portion of the support panel extend upwardly therefrom and are disposed generally parallel and spaced apart so that the lower edge of an open book may be retained on said first planar portion between the front panel and the second planar portion, the spine of the book inclined against and supported by the second planar portion. The spacing of the front panel and the support panel may be adjusted by the selective amount of insertion of the first planar portion through the slot. At least the front panel is formed of transparent material so that the book portion disposed behind the front panel is visible to the reader.

The base member and support member may be formed entirely of transparent plastic or resin material. With the base member and support member separated, the first and second planar portions may be disposed to impinge on the front and back covers of a book, and secured thereabout by an elastic band, so that the two members form a protective enclosure for the book while being carried therewith. To facilitate this assembly, a hole or similar mounting component may be provided in the front panel, and an elastic band secured thereto and dimensioned to be secured about the base member, support member, and book protected therebetween. Alternatively, one of the members may be inserted between the pages of a book as a page marker, and the other member secured to an outer cover of the book.

DESCRIPTION OF THE PREFERRED EMBODIMENT

Figure 6:
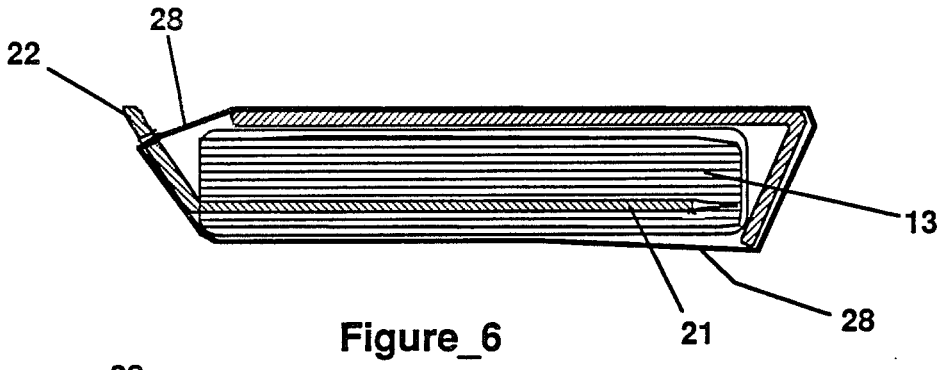
FIG. 6 is an end elevation of the present invention in the disassembled configuration joined to a book, with the support member forming a page marker therefor.

The present invention generally comprises a book stand that is particularly adapted to be portable with a book with which it is to be used. As shown in FIGS. 1–4, the book stand generally includes a base member 11 and a support member 12 which are adapted to be releasably joined together to form a stand to support an open book 13 or the like. The base member includes a base panel 14, and a front panel 16 extending from one end of the base panel and formed integrally therewith. The front panel and base panel define an acute angle of approximately 70°, although this angle is not a critical factor. The factor panel 16 includes a distal edge portion having two lobes 17 defined and separated by a concave recess 18 extending into the front panel, for purposes to be explained in the following description. The front panel is substantially shorter in length than the base panel, and is formed of a transparent material.

The support member 12 includes a support panel 21, with a bottom panel 22 extending from one edge thereof at an oblique angle of approximately 110°. The support panel further includes a slot 23 extending through the support panel 21 directly adjacent the conjunction with the bottom panel. The slot 23 is dimensioned to be slightly wider than the base panel 14, so that the base panel is slidably received through the slot 23. Furthermore, the slot 23 is centered in the width of the support panel to define laterally opposed webs 24 that link the support panel and front panel and provide structural connection therebetween that is sufficiently strong to support the weight of a large book inclined against the support panel.

The base panel is inserted through the slot 23 a sufficient distance to dispose the front panel and support panel 21 in spaced apart, parallel relationship. The base panel extends parallel to and impinging on the bottom panel, and the bottom panel and base panel are disposed to be supported on a horizontal surface 26, such as a table, desk, or the like. Indeed, the substantial portion of the base panel extending through the slot 23 and impinging on the horizontal surface forms an extremely stable base structure to support the weight of a book inclined against the support panel 21. The bottom edge of an open book may rest on the portion of the base panel extending between the slot 23 and the front panel, with the front panel impinging on the lower portions of the pages of the open book to retain the book on the book stand. Indeed, the lobes 17 are disposed each to impinge on one of the pair of pages displayed by the open book. For this reason, the front panel 16 is formed of transparent material, so that any printed material at the lower extent of these pages may be viewed directly through the front panel. The rounded lobes 17 are provided so that the pages displayed and impinged upon may be turned manually without hindrance.

In the preferred embodiment the base member and support member are formed entirely of transparent, planar material, such as plastic panels of acrylic, polycarbonate, or similar material. The front panel may be integrally formed with the base panel, and the bottom panel may be formed integrally with the support panel. Alternatively, the members may be formed of lightweight metal such as aluminum, although a transparent front panel is desirable to facilitate viewing of the lower portions of the pages displayed.

It is significant to note that the book stand is adjustable to accommodate books of differing thickness, format size, and the like. Books of substantial thickness are accommodated by increasing the spacing of the front panel and support panel, thin books by decreasing the spacing. The angle of repose of the book 13 may be adjusted in like manner by adjusting the spacing of the front panel and support panel.

Figure 5:
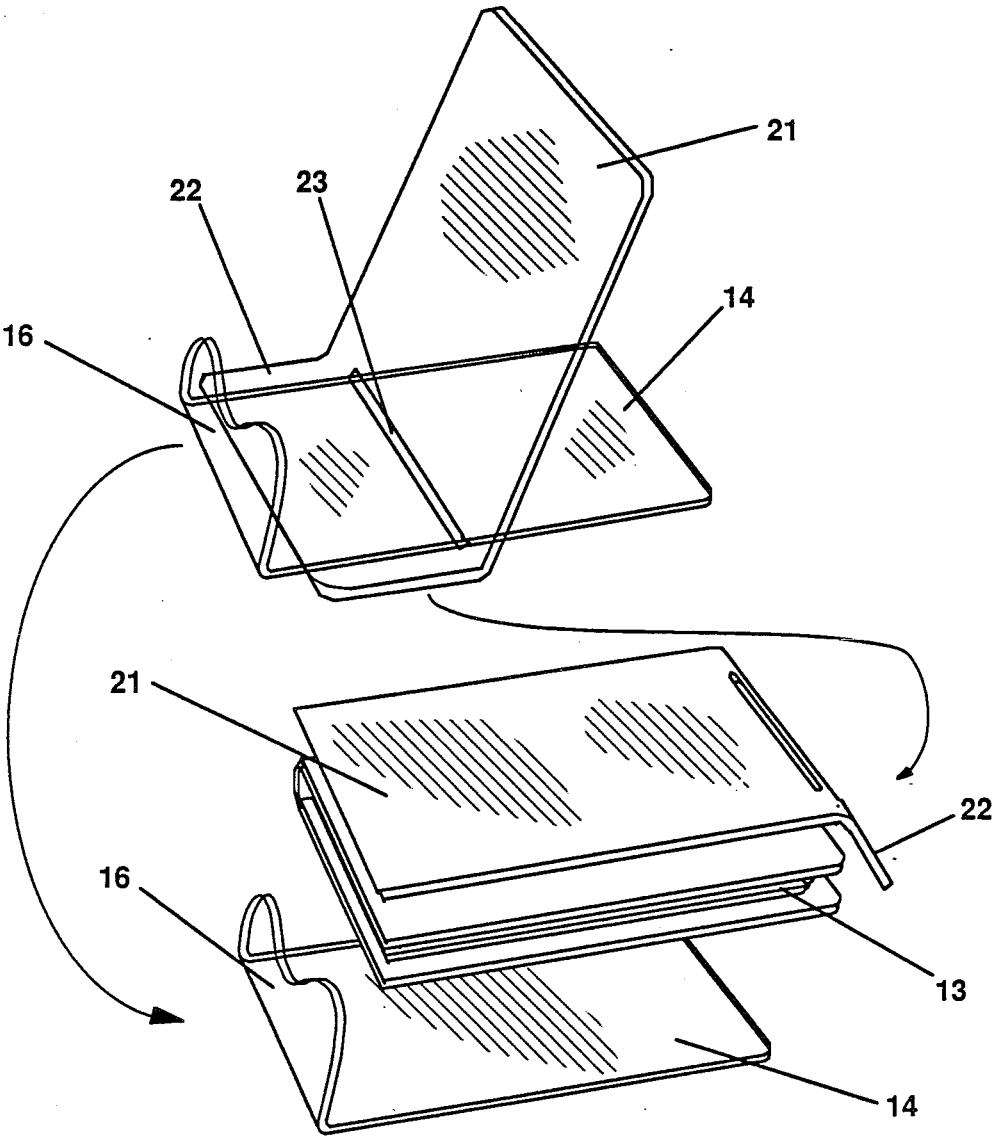
FIG. 5 is a schematic view showing the book stand of the present invention reconfigured from an assembled book stand to a protective book enclosure.

An important aspect of the present invention is that the book stand is disassembled easily by pulling the base panel out of the slot 23. Furthermore, the base member and support member not only are lightweight and very portable, but also they may be reconfigured to serve as a protective enclosure for a book that they accompany. As shown in FIG. 5, the base panel 14 and support panel 21 may be disposed to overlay the front and back covers of the book 13, with the front panel 16 and bottom panel 22 extending adjacent to the outer edges of the book. The panels 16 and 22 thus provide substantial protection for the book 13, especially while it is being carried by hand or in a bag, satchel, case, or the like. To facilitate such use, a hole 27 is provided in a medial portion of the bottom panel 22 (or alternatively in an edge portion of the support panel 21), and an elastic band or loop 28 is secured in the hole 27. The member 28 may be wrapped about the assembly of the two book stand members and the book (FIG. 7), to secure the members to the book for protective purposes as well as for the convenience of transporting the book stand with the book with which it is to be used. The front panel and bottom panel may be oriented to protect the binding and opposed side of the book, or may be oriented to protect the opposed ends of the book, or any combination or variation thereof, as is deemed desirable by the user.

One of the members of the book stand may be used as a page marker as the members are transported with a book. As shown in FIG. 6, the support panel 21 (or, alternatively, the base panel 14) may be inserted between selected pages of the book 13 to mark the progress of the reader, with the base panel (alternatively, support panel 21) secured adjacent to and impinging on one cover of the book 13. As before, the elastic band member 28 extends under tension about the assemblage to retain the book stand members to the book 13.

Figure 7:
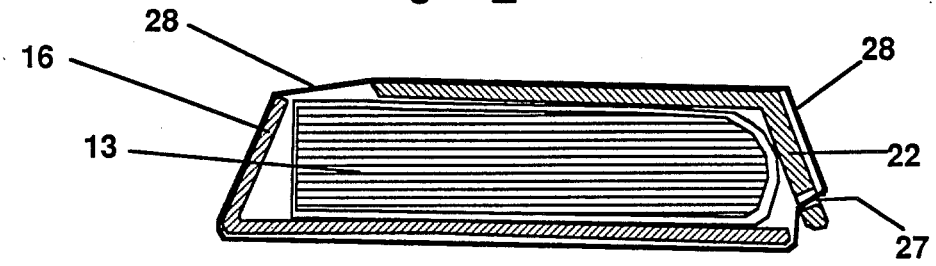
FIG. 7 is an end elevation of a book within the protective enclosure formed of the support member and base member of the book stand of the present invention.
Figure 1:
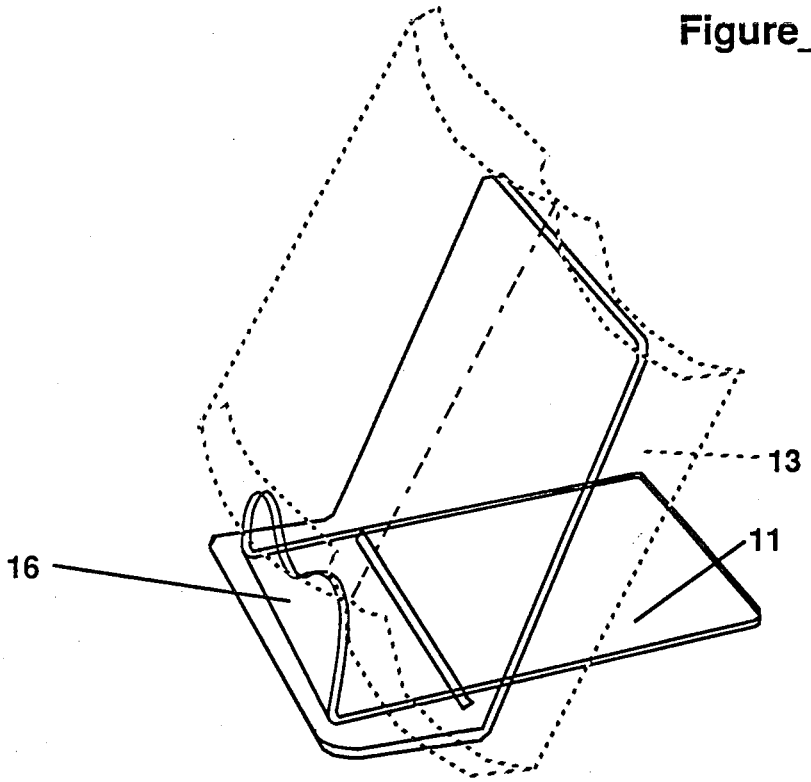
FIG. 1 is a perspective view of the book stand of the present invention, shown assembled and supporting an open book.
Figure 2:
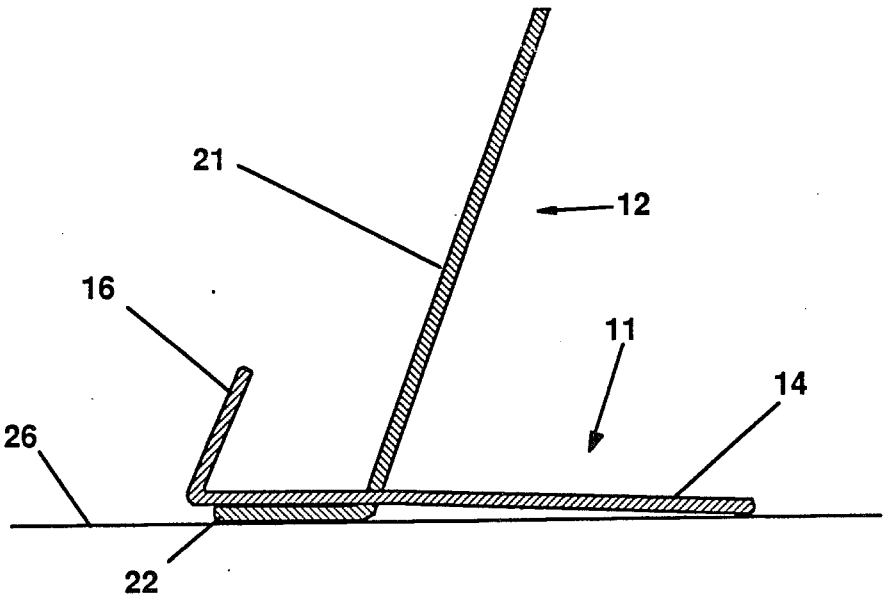
FIG. 2 is a cross-sectional side elevation of the book stand of the present invention in the assembled configuration.
Figure 3:
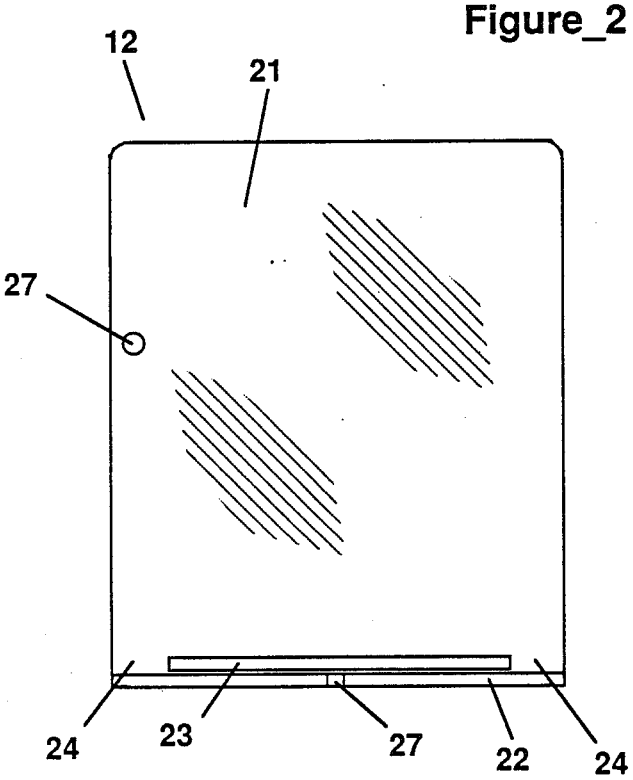
FIG. 3 is a front elevation of the support member of the book stand of the present invention.
Figure 4:
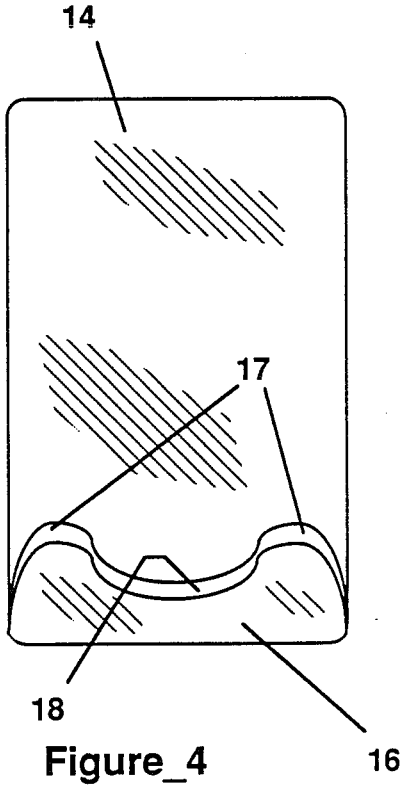
FIG. 4 is a front elevation of the base member of the book stand of the present invention.

In either of the configurations shown in FIGS. 6 and 7, the book stand members 11 and 12, when joined to the book 13, permit holding and carrying the assembly as easy as holding and carrying the book itself. At the same time, the members 11 and 12 provide substantial protection for the book, and can act as a page marker. Thus it may be seen that the components of the present invention are as portable as the book, and the book stand may become a standard accompaniment for a book, both for the convenience of having a book stable available at any instant and for the protection afforded by the enclosure of the members secured about the book.

Due to the fact that the support panel and base panel are adapted to be disposed either as a protective enclosure or a page marker in the knock-down, transportable configuration, these panels are preferably fashioned in retangular form, as are all books. However, curved or other angular forms may be used for the panels without departing from the concept and spirit of the invention.

Although the present invention is described with reference to displaying an open book, it may be appreciated that the invention may also be used as a copy stand for typists, a decorative display for printed material, or the like.

We claim:

1. A portable book stand for supporting an open book including base means for engaging a horizontal surface, support means releasably secured to said base means and upwardly extending therefrom to support and display a book inclined against said support means, means for separating and reconfiguring said support means and base means as a protective enclosure to be secured about a book, said base means including a base member, said base member including a base panel adapted to impinge on the horizontal surface, said base member further including a front panel extending from one edge of said base panel and defining an acute angle therewith, said front panel including an upper edge having a pair of rounded lobes extending generally upwardly therefrom and spaced apart laterally to engage lower edge portions of opposed pages of an open book supported by said stand.

2. The book stand of claim 1, wherein said front panel is formed of a transparent material.

3. The book stand of claim 1, wherein said base member and said support means are formed of transparent, form-retaining material.

4. A stand for supporting reading material, comprising a base member having a base panel adapted to impinge on a horizontal surface and a front panel extending from one edge of said base panel and defining an oblique angle therewith, a support member having a support panel extending upwardly from the horizontal surface and a bottom panel extending from a lower edge of said support panel and defining an oblique angle therewith, slot means in said support member for receiving therethrough a portion of said base panel in slidable fashion, said front panel and said support panel oriented in generally parallel, spaced apart disposition to retain reading material therebetween, the reading material inclined against said support panel and supported thereby, wherein said front panel and said support panel are disposed in adjustably variable spacing according to the extent to which said portion of said base panel is inserted through said slot means, further including means for separating and reconfiguring said support means and base means from an in-use position to a protective enclosure to be secured about a book by removing said base panel from said slot means, wherein said support panel is disposed to impinge on one outer cover of a closed book, and said base panel is disposed to impinge on the other outer cover of the closed book, said front panel and said bottom panel disposed adjacent to sides of the closed book in protective fashion, and means for securing said support means and said base means as said protective enclosure about the book.

5. The book stand of claim 4, wherein said front panel includes a pair of laterally spaced lobes at a distal upper edge thereof.

6. The stand of claim 4, wherein said front panel includes an upper edge having a pair of lobes extending generally upwardly therefrom and spaced apart laterally to engage lower edge portions of opposed pages of an open book supported by said stand.

7. The book stand of claim 12, wherein said means for securing includes an elastic band extending about said base panel and said support panel with the book disposed therebetween.

* * * * *